United States Patent [19]

Dennis

[11] 4,354,288

[45] Oct. 19, 1982

[54] BED FRAME WITH PYRAMID SHAPED PLATFORM SUPPORTS

[76] Inventor: Joseph W. Dennis, 4054 Little Richmond Rd., Dayton, Ohio 45427

[21] Appl. No.: 193,676

[22] Filed: Oct. 3, 1980

[51] Int. Cl.[3] ..... A47C 19/00

[52] U.S. Cl. ..... 5/400; 5/201; 52/292; 108/56.1; 248/346

[58] Field of Search ..... 5/451, 452, 400, 401, 5/411, 131, 200 R, 200 B, 201; 108/56.1; 248/348, 678; 52/292, 800, 73; D6/79

[56] References Cited

U.S. PATENT DOCUMENTS

| | | | |
|---|---|---|---|
| 3,696,761 | 10/1972 | Brown | 108/56.1 |
| 3,724,007 | 4/1973 | Kuss | 5/451 |
| 4,110,854 | 9/1978 | Sjolie | 5/411 |
| 4,160,296 | 7/1979 | Fogel | 5/400 |
| 4,267,781 | 5/1981 | Powers | 108/56.1 |

FOREIGN PATENT DOCUMENTS

| | | | |
|---|---|---|---|
| 797130 | 6/1958 | United Kingdom | 248/346 |

*Primary Examiner*—Alexander Grosz
*Attorney, Agent, or Firm*—Biebel, French & Nauman

[57] ABSTRACT

A bed or bed frame is disclosed including a base plate on which is mounted a plurality of pyramids which have their bases arranged in a contiguous side-by-side manner with truncated apices in a common plane, and a bedding support or platform is mounted and support on the pyramids at the common apices.

3 Claims, 3 Drawing Figures

BED FRAME WITH PYRAMID SHAPED PLATFORM SUPPORTS

BACKGROUND OF THE INVENTION

This invention relates to the art of beds and bedding supports, and more particularly to a novel bed.

SUMMARY OF THE INVENTION

The invention is directed to a platform-type of bed or bed frame in which a bedding platform is supported directly on a plurality of underlying rigid pyramids, which are, in turn, preferably mounted on a subbase, in which the pyramids are oriented with their apices in immediate underlying and supporting relation to the mattress supporting surface of the platform. The arrangement of the present invention is directed to appeal, into the market place, to the segment of the buying public which believes that there is an unseen force or extraterrestrial power associated with the form or shape of the pyramid, and provides a utilitarian bed frame or bedding support incorporating, as a major component thereof, a plurality of structural units in the shape of pyramids.

It is accordingly an important object of the present invention to provide a novel bed or bedding support in which a bedding support platform is mounted at the apices of a plurality of rigid pyramids which have their bases joined together in contiguous relation.

These and other objects and advantages of the invention will be apparent from the following description, the accompanying drawings, and the appended claims.

DESCRIPTION OF PREFERRED EMBODIMENT

Figure 1:
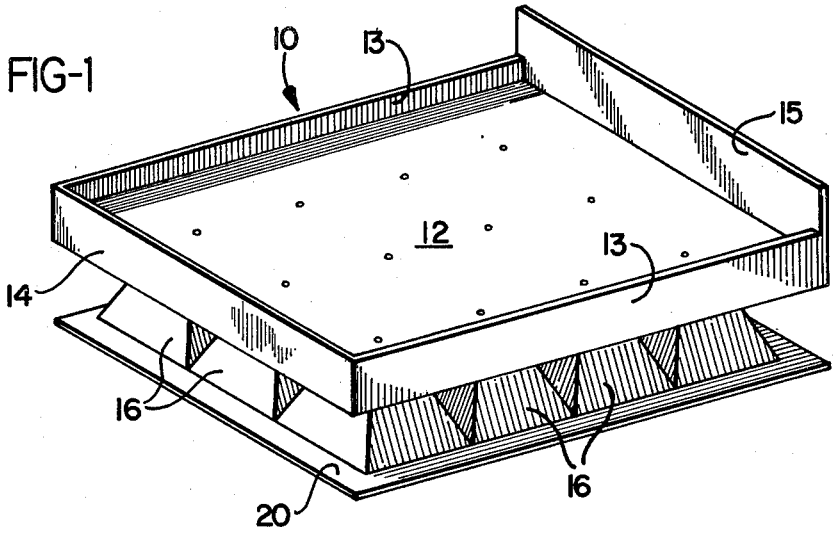
FIG. 1 is a perspective view of a bed in accordance with my invention.
Figure 2:
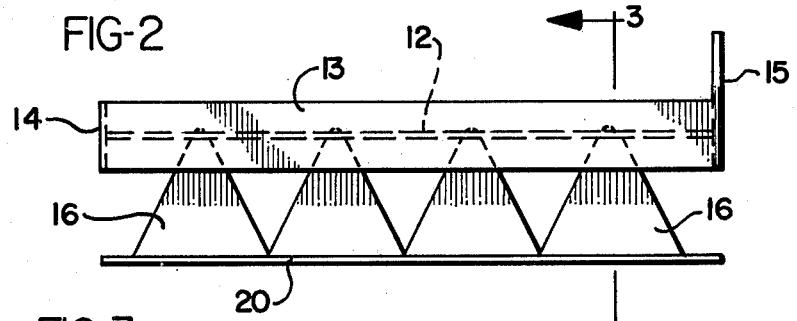
FIG. 2 is a side elevational view thereof.

Referring to the figures of the drawing, a bed or platform type bedding support is illustrated generally at 10 in FIG. 1 as including an upper generally horizontal platform 12 which may have surrounding sides 13, a footboard 14, and a headboard 15 mounted thereon. It is understood that the sides 13 and the footboard 14 as well as the headboard 15 may be eliminated, and the usual mattress tabs and headboard brackets employed, as in conventional bed rail constructions. However, the present construction is preferred as it securely supports a box spring or mattress thereon and may also be employed to support a water bed type of mattress.

The sides 13, as well as the footboard 14 and headboard 15 extend both above and slightly below the platform 12, as shown in the sectional view of FIG. 3, to provide a depending skirt portion, for appearance purposes.

Means for supporting the platform 12 in elevated relation to the floor comprises a plurality of substantially identical pyramid elements illustrated generally at 16. The pyramid elements, in the preferred embodiment, are formed with four equal sides 17 joined at a somewhat truncated top 18. The bases of the pyramids are preferably open, and are positioned in contiguous relation to each other on a subbase or foundation board 20. The truncated apices or tops 18 are in a common plane.

Figure 3:
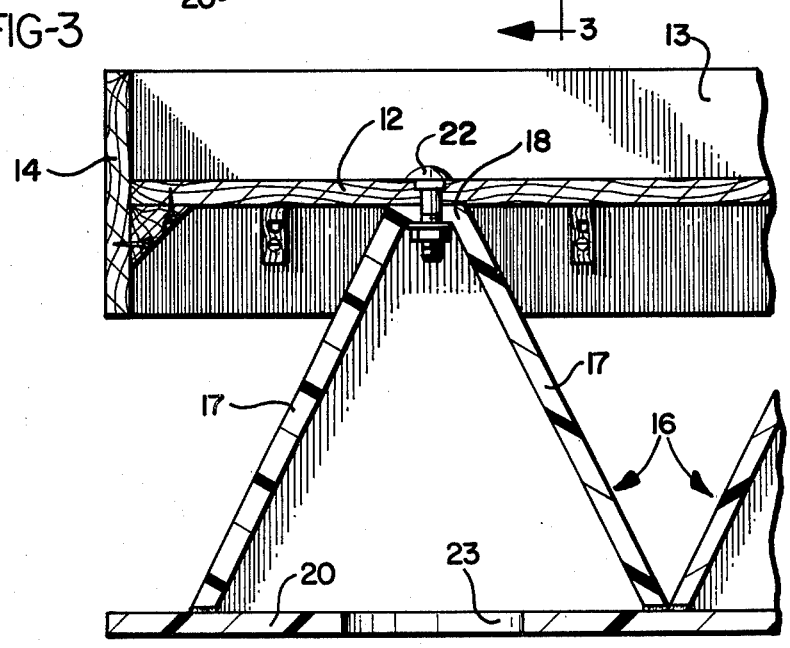
FIG. 3 is an enlarged fragmentary sectional view taken generally the line 3—3 of FIG. 2.

The means for securing the platform 12 to the apices or tops 18 of the individual pyramids 16 may comprise a simple machine bolt 22 received therethrough and threaded from underneath, as illustrated in FIG. 3. For this purpose, the baseboard 20 may be provided with apertures 23 through which the machine bolt 22 and its associated nut may be reached for tightening or loosening. Lower terminal edges of the pyramid sides 17 are suitably bonded or otherwise secured to the base plate 20, such as by epoxy glue nail, thermal bonding, or the like.

The platform 12, the pyramids 16 and the subbase or foundation board 20 may be formed of any suitable materials, such as hardboard, plywood, plastic sheeting, molded plastic, metal or the like.

The plurality of pyramids 16 positioned with their bases in side-by-side relation, provide an exceedingly rigid structure, which may support, in compression, a substantial weight or force applied to the platform 12. Accordingly, the individual pyramids work together as a unit to support the platform 12 and may be made of relatively light material, since the supporting effect is cumulative.

It is understood that the bed of the present invention is not limited to the employment of a four-sided pyramid as illustrated. The pyramid 15 may have as few as three sides, or as many as an infinite number of sides and in fact, if desired, may be formed in a generally conical shape, with the bases thereof contiguous or touching at their outer perimeters.

While the form of apparatus herein described constitutes a preferred embodiment of this invention, it is to be understood that the invention is not limited to this precise form of apparatus, and that changes may be made therein without departing from the scope of the invention.

What is claimed is:

1. A bed comprising a generally horizontally oriented platform, a plurality of underlying rigid pyramids, each of substantially the same height, having their bases arranged in contiguous manner and have apices lying in a common plane, means attaching said platform to said apices, and means in said bases defining an aperture for access to said attaching means.

2. A bed frame comprising a base plate, a plurality of pyramids having their bases mounted to said base plate and extending upwardly therefrom on one side of said base plate and terminating in apices arranged in a generally common plane, a bedding supporting platform mounted to said pyramids at said apices, means attaching said platform to said pyramids at said apices, and means in said base plate defining apertures for access to said attaching means.

3. A bed comprising a bedding support, a plurality of rigid pyramids, each of substantially the same height, having their bases arranged in contiguous manner and having apices in a generally common plate, means attaching said bedding support to said pyramids at the apices thereof, a common base plate supporting said pyramids at the base thereof, and means in said base plate defining access openings for access to said attaching means.

* * * * *